US006644631B2

(12) United States Patent
Suzuki

(10) Patent No.: US 6,644,631 B2
(45) Date of Patent: Nov. 11, 2003

(54) DIAPHRAGM-TYPE CARBURETOR

(75) Inventor: Masao Suzuki, Miyagi-ken (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 10/299,347

(22) Filed: Nov. 19, 2002

(65) Prior Publication Data

US 2003/0102579 A1 Jun. 5, 2003

(30) Foreign Application Priority Data

Nov. 30, 2001 (JP) ..... 2001-367375

(51) Int. Cl.[7] ..... F02M 37/20

(52) U.S. Cl. ..... 261/35; 261/57; 261/63; 261/DIG. 81

(58) Field of Search ..... 261/35, 57, 54, 261/55, 63, DIG. 67, DIG. 81

(56) References Cited

U.S. PATENT DOCUMENTS 3,321,192 A * 5/1967 Phillips ..... 261/35
3,738,623 A * 6/1973 Tuckey ..... 261/35
4,003,968 A * 1/1977 Rickert ..... 261/35
4,684,484 A * 8/1987 Guntly ..... 261/35
4,735,751 A * 4/1988 Guntly ..... 261/35
4,861,522 A * 8/1989 Gerhardy et al. ..... 261/35
4,903,655 A * 2/1990 Vonderau et al. ..... 123/198 C
4,931,226 A * 6/1990 Ishii ..... 261/41.5
5,133,905 A * 7/1992 Woody et al. ..... 261/35
5,599,484 A * 2/1997 Tobinai ..... 261/44.2
6,202,988 B1 * 3/2001 Abe et al. ..... 261/34.1
6,425,573 B1 * 7/2002 Suzuki ..... 261/35
6,536,747 B2 * 3/2003 Burns et al. ..... 261/35

* cited by examiner

*Primary Examiner*—Richard L. Chiesa
(74) *Attorney, Agent, or Firm*—Reising, Ethington, Barnes, Kisselle, P.C.

(57) ABSTRACT

A diaphragm-type carburetor has a body defining at least in part an air intake passage, a fuel metering chamber that receives fuel for delivery into the air intake passage, a fuel supply passage communicating a supply of fuel with the fuel metering chamber, and a bypass passage communicating the fuel supply passage with the air intake passage to facilitate removal of air and fuel vapor from the carburetor. The bypass passage is routed around, and does not communicate directly with the fuel metering chamber. Fuel vapor or air in the carburetor is quickly led from the bypass passage to the air intake passage to prevent a large quantity or volume of fuel vapor or air from staying in or flowing to the fuel metering chamber and thereby adversely affecting the operation of the carburetor.

11 Claims, 1 Drawing Sheet

DIAPHRAGM-TYPE CARBURETOR

REFERENCE TO RELATED APPLICATION

Applicant claims priority of Japanese patent application, Ser. No. 2001-367375, filed Nov. 30, 2001.

FIELD OF THE INVENTION

The present invention relates to a carburetor, and more particularly to a diaphragm-type carburetor that provides a fuel and air mixture to an engine.

BACKGROUND OF THE INVENTION

Diaphragm-type carburetors are commonly used to supply a fuel and air mixture to an engine in accordance with engine demand. Such carburetors use a diaphragm to control at least in part the flow of liquid fuel in the carburetor in response to a signal applied to the diaphragm.

The presence of air and fuel vapor in the carburetor can inhibit liquid fuel flow in the carburetor. This can make it difficult to start an engine, and even after the engine is started, can cause unstable engine operation if the fuel vapor is not purged quickly. Air and fuel vapor can become present in the carburetor, for example, when an engine is not operated for a long period of time, or a hot engine is left out in hot ambient conditions.

SUMMARY OF THE INVENTION

A diaphragm-type carburetor has a body defining at least in part an air intake passage, a fuel metering chamber that receives fuel for delivery into the air intake passage, a fuel supply passage communicating a supply of fuel with the fuel metering chamber, and a bypass passage communicating the fuel supply passage with the air intake passage to facilitate removal of air and fuel vapor from the carburetor. The bypass passage is routed around, and does not communicate directly with the fuel metering chamber. Fuel vapor or air in the carburetor is quickly led from the bypass passage to the air intake passage to prevent a large quantity or volume of fuel vapor or air from staying in or flowing to the fuel metering chamber and thereby adversely affecting the operation of the carburetor. The present invention may be used in carburetors of substantially any type including without limitation those having piston, rotary, butterfly, barrel or slide type throttle valves.

DETAILED DESCRIPTION OF THE PREFERRED EMBODIMENTS

Figure 1:
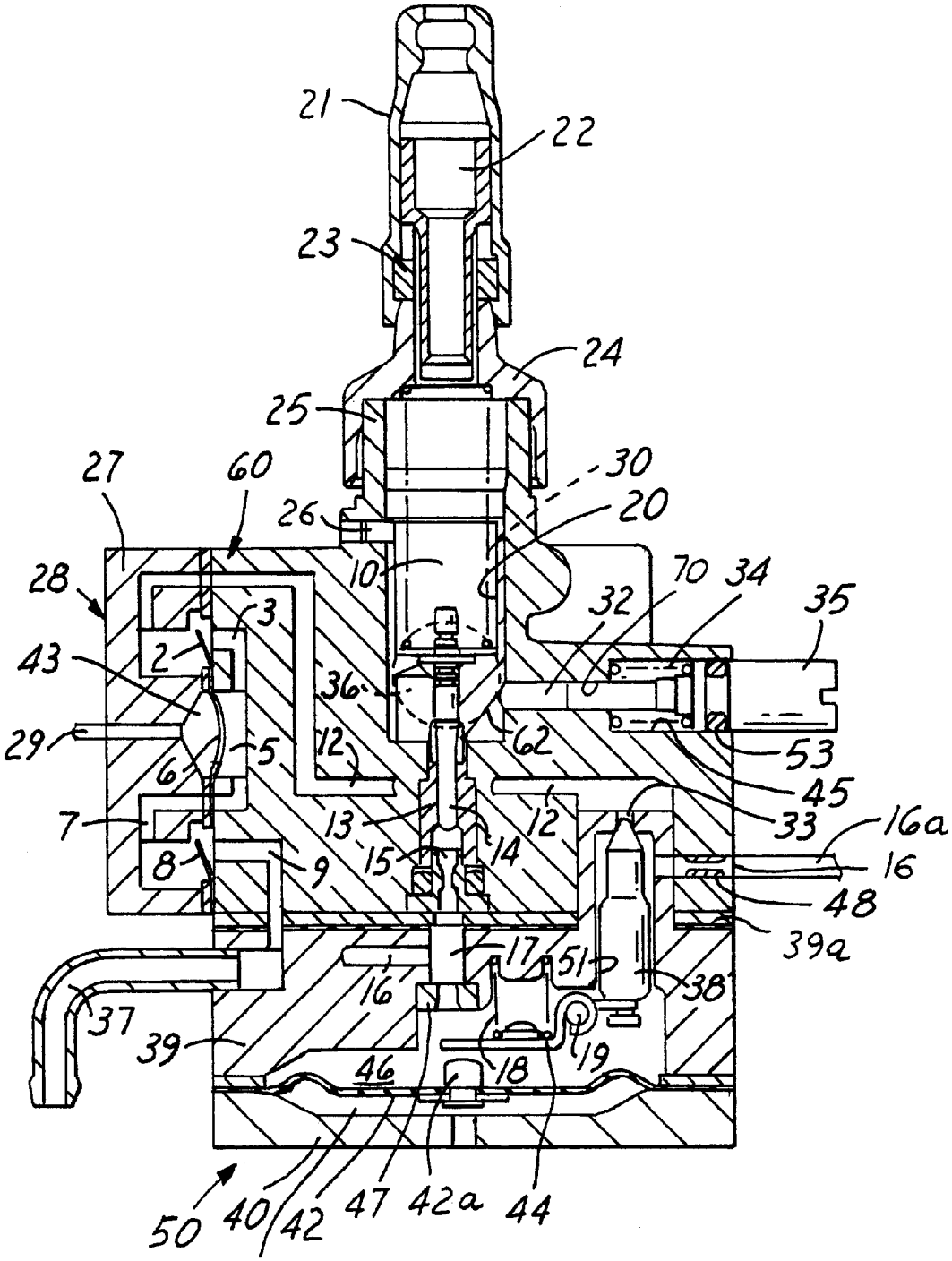
FIG. 1 is a front sectional view of a diaphragm type carburetor according to one embodiment of the present invention.

As shown in FIG. 1, a carburetor body 60 is formed with an air intake passage 36 extending therethrough, a cylindrical valve chamber 20 perpendicular to the air intake passage 36, and a piston type throttle valve 10 is slidably received in the valve chamber 20. The valve chamber 20 is aligned with a cylindrical portion 25 projecting upward from the carburetor body 60. A fixed metal fitting 22 for supporting an outer tube of a remote control cable is fitted into a tube 24 threadedly fitted on the cylindrical portion 25. The metal fitting 22 is covered by a cap 21. An inner wire (not shown) inserted into the outer tube is connected to the throttle valve 10 in a manner known in the art.

To bias the throttle valve toward its idle position, a return spring 30 is interposed between the tube 24 and the throttle valve 10. To facilitate adjustment of the idle position of the throttle valve 10, an inclined cam surface 62 is formed at the lower end of the throttle valve 10. An idle adjustment bolt 35, an O-ring 53, and a spring 34 are fitted in a cylindrical bore 45 in the carburetor body 60. A rod 32 extended from an end of the idle adjustment bolt 35 is threaded in a tapped hole 70 aligned with the bore 45. The outer end of the rod 32 contacts the cam surface 62 when the throttle valve 10 is in its idle position. Hence, axial movement of the rod 32 varies the location of the engagement of the rod 32 with the cam surface 62 to control the idle position of the throttle valve 10. A fuel adjustment needle valve 14 is carried by the throttle valve 10 and is fitted into a fuel supply pipe 13. The fuel supply pipe 13 is received in the carburetor body 60 so that its upper end projects toward the valve chamber 20 to provide a main fuel nozzle.

A plate 27 is connected to the carburetor body 60 with a fuel pump diaphragm 6 sandwiched therebetween to form in part a fuel pump 28. A pulsation pressure chamber 43 is defined in part by the diaphragm 6 and a passage 29 communicates crankcase pressure pulses with the chamber 43. The pressure pulses displace the diaphragm 6, and a pump chamber 5 on one side of the diaphragm 6 alternately expands and contracts. Fuel in a fuel tank, not shown, is taken into the pump chamber 5 via a fuel inlet pipe 37, a passage 9, a check valve 8 and a passage 7, and further fed to a fuel metering chamber 46 via a passage 3, a check valve 2, and a fuel supply passage 12 including a valve chamber 51 accommodating an inlet valve 38. The check valves 2 and 8 may be flaps formed integrally with diaphragm 6. The fuel pump 28 as shown and described may be of conventional construction.

A fuel metering assembly 50 is also provided in the carburetor. An intermediate plate 39 is connected to the carburetor body 60 with a gasket 39*a* sandwiched therebetween. An end plate 40 is connected to the lower surface of the intermediate plate 39 with a fuel metering diaphragm 42 sandwiched therebetween. The fuel metering chamber 46 and an atmospheric chamber 41 are formed on opposite sides of the diaphragm 42. A lever 44 is supported by a shaft 19 in the fuel metering chamber 46. One end of the lever 44 is biased against a center projection 42*a* of the diaphragm 42, and the other end of the lever 44 is engaged with a lower end of the inlet valve 38. When the volume of the fuel metering chamber 46 is reduced, the diaphragm 42 is moved upwardly (as viewed in FIG. 1) by the intake vacuum pressure of the air intake passage 36, the lever 44 rotates clockwise, the inlet valve 38 is opened, and fuel is supplied from the fuel pump 28 to the fuel metering chamber 46. When the fuel metering chamber 46 is filled with fuel, the diaphragm 42 is pushed downwardly (as viewed in FIG. 1.) increasing the volume of the fuel metering chamber 46, the lever 44 rotates counterclockwise and the inlet valve 38 engages a valve seat 33 to close and thereby stop fuel flow into the fuel metering chamber 46.

As shown in FIG. 1, to communicate the fuel supply passage 12 with the air intake passage 36, a bypass passage 16 is provided. In the embodiment shown, the bypass passage 16 is open at an inlet end to the valve chamber 51 (downstream of valve seat 33) and an orifice or restriction 48 is preferably provided generally adjacent to the fuel supply passage 12 at the inlet end of the bypass passage 16. The restriction 48 suppresses excessive fluid flow from the valve chamber 51 to the bypass passage 16 to avoid undue interference with the operation of the fuel metering assembly 50. The other end, or outlet end, of the bypass passage 16 opens into a connecting passage 17 that communicates the fuel metering chamber 46 with the air intake passage 36 through the fuel supply pipe 13. A restriction 47 is preferably provided at an inlet of the connecting passage 17 between the fuel metering chamber 46 and the outlet end of the bypass passage 16.

Preferably, the bypass passage 16 is routed around and does not communicate directly with the fuel metering chamber 46. In the embodiment shown, the bypass passage communicates with the fuel supply passage in the area of the valve chamber 51, which in turn is open to the fuel metering chamber 46. At the other end, the bypass passage 16 communicates with the connecting passage 17, which in turn is open to the fuel metering chamber 46 (through the restriction 47). Of course, other arrangements of the various chambers and passages, including the bypass passage 16, may be employed. Also, while the bypass passage 16 is shown as being formed partly within the carburetor body 60 and partly outside the body 60, such as by a tube or hose 16*a*, the bypass passage 16 can be formed in other ways. For example, the bypass passage 16 can be formed entirely within the carburetor body 60 or entirely outside the body 60 as desired. Additionally, as used herein, the body of the carburetor includes main body 60 and the various plates (e.g. plates 27, 39, 40 in the embodiment shown) and bodies attached thereto.

When, for example, the operation of the engine is stopped and the engine is left in hot ambient conditions, such as out in the blazing sun, fuel vapor and/or air forms or remains in the pump chamber 5 of the fuel pump 18, the fuel passage 12, the inlet of the inlet valve 38 or the valve chamber 51. This fuel vapor and/or air impairs or inhibits a smooth flow of fuel from the fuel pump 28 to the fuel metering chamber 46 at the re-start of the engine. Particularly, when the inlet valve 38 is opened, fuel vapor occurs at the inlet portion of the inlet valve 38 due to sudden lowering of fuel pressure.

Upon cranking of the engine to start it, vacuum pressure generated in the air intake passage 36 is communicated to the connecting passage 17 through the fuel supply pipe 13. Fuel vapor or air in the clearance space between the valve housing 51 and the inlet valve 38 is taken into the air intake passage 36 via the restriction 48, the bypass passage 16, the connecting passage 17 and the fuel supply pipe 13. In this manner, fuel vapor or air in the passage between the fuel pump 28 and the fuel metering chamber 46 is discharged into the air intake passage 36 quickly. With this air and fuel vapor removed from the carburetor, a more uniform flow of liquid fuel can be obtained from the fuel pump 28 to the fuel metering chamber 46, and from the fuel metering chamber 46 to the air intake passage 36 (through the restriction 47, the connecting passage 17 and the fuel supply pipe 13). Therefore, it is possible to suppress or prevent the flow of a large quantity of fuel vapor and/or air to the fuel metering chamber upon initial starting of the engine, providing a smoother start and initial idle operation of the engine.

With any large volume of fuel vapor and/or air removed from the fuel circuit, liquid fuel can promptly fill the passages between the fuel pump and inlet valve, and readily flow into the metering chamber to ensure its steady operation. Even if some fuel vapor and/or air remains, for example, in the clearance area between the valve chamber 51 and inlet valve 38, this area is relatively small in volume and, in general, lesser quantities of fuel vapor and/or air do not significantly affect engine operation. It is noted that the present invention can be applied not only to the carburetor provided with a piston-type throttle valve, but also to carburetors provided with a barrel or other rotary throttle valve, or a butterfly-type throttle valve.

What is claimed is:

1. A carburetor, comprising:

a body;

an air intake passage defined at least in part in the body;

a fuel metering chamber in fluid communication with the air intake passage and adapted to receive a supply of fuel to be fed into the air intake passage;

a fuel supply passage defined at least in part in the body communicating a supply of fuel with the fuel metering chamber; and a bypass passage communicating the fuel supply passage with the air intake passage wherein the bypass passage is not in direct communication with the fuel metering chamber.

2. The carburetor of claim 1 which also comprises a valve seat and an inlet valve received in the fuel supply passage for movement between an open position and a closed position engaged with the valve seat to selectively permit fluid flow through the inlet valve to the fuel metering chamber, and wherein the bypass passage communicates with the fuel supply passage downstream of the valve seat.

3. The carburetor of claim 2 wherein the fuel supply passage has a valve chamber in which the inlet valve is received and the bypass passage communicates with the valve chamber.

4. The carburetor of claim 1 which also comprises a restriction in the bypass passage to control the fluid flow rate through the bypass passage.

5. The carburetor of claim 4 wherein the restriction is disposed generally adjacent to an inlet end of the bypass passage that communicates with the fuel supply passage.

6. The carburetor of claim 4 wherein the restriction is disposed generally adjacent to an outlet end of the bypass passage.

7. The carburetor of claim 6 wherein the restriction is disposed between the outlet end of the bypass passage and the fuel metering chamber.

8. The carburetor of claim 2 which also comprises a connecting passage between the fuel metering chamber and the air intake passage, and wherein the bypass passage communicates with the connecting passage.

9. The carburetor of claim 8 which also comprises a restriction disposed generally between the fuel metering chamber and the connecting passage.

10. The carburetor of claim 2 which also comprises a fuel metering diaphragm that defines in part the fuel metering chamber such that movement of the fuel metering diaphragm varies the volume of the fuel metering chamber, and wherein the inlet valve is moved between its open and closed positions in response to movement of the fuel metering diaphragm.

11. The carburetor of claim 1 which also comprises a tube routed at least in part outside of the body and wherein the bypass passage is defined at least in part by the tube.

* * * * *